US010879602B2

(12) United States Patent
Göttl et al.

(10) Patent No.: US 10,879,602 B2
(45) Date of Patent: Dec. 29, 2020

(54) RADOME AND ASSOCIATED MOBILE COMMUNICATIONS ANTENNA, AND METHOD FOR PRODUCING THE RADOME OR THE MOBILE COMMUNICATIONS ANTENNA

(71) Applicant: Telefonaktiebolaget LM Ericsson (publ), Stockholm (SE)

(72) Inventors: Maximilian Göttl, Frasdorf (DE); Robert Kinker, Rosenheim (DE); Philipp Gentner, Rosenheim (DE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 392 days.

(21) Appl. No.: 15/552,712

(22) PCT Filed: Feb. 22, 2016

(86) PCT No.: PCT/EP2016/053634

§ 371 (c)(1),
(2) Date: Aug. 22, 2017

(87) PCT Pub. No.: WO2016/135080

PCT Pub. Date: Sep. 1, 2016

(65) Prior Publication Data

US 2018/0040948 A1 Feb. 8, 2018

Related U.S. Application Data

(60) Provisional application No. 62/525,269, filed on Jun. 27, 2017.

(30) Foreign Application Priority Data

Feb. 26, 2015 (DE) ..... 10 2015 002 441

(51) Int. Cl.
*H01Q 1/42* (2006.01)
*H01Q 1/24* (2006.01)
(Continued)

(52) U.S. Cl.
CPC ..... *H01Q 1/42* (2013.01); *H01Q 1/246* (2013.01); *H01Q 15/0013* (2013.01); *H01Q 19/108* (2013.01); *H01Q 21/26* (2013.01)

(58) Field of Classification Search
CPC ..... H01Q 1/42; H01Q 1/246; H01Q 15/00
See application file for complete search history.

(56) References Cited

U.S. PATENT DOCUMENTS 5,710,569 A 1/1998 Oh et al.
6,069,590 A * 5/2000 Thompson, Jr. ..... H01Q 1/42 343/795
(Continued)

FOREIGN PATENT DOCUMENTS

DE 196 27 015 1/1998
DE 197 22 742 12/1998
(Continued)

OTHER PUBLICATIONS

International Search Report for PCT/EP2016/053634, dated May 17, 2016, 5 pages.
(Continued)

*Primary Examiner* — Hasan Z Islam
(74) *Attorney, Agent, or Firm* — Sage Patent Group

(57) ABSTRACT

An improved radome and an associated improved method for producing a radome has a radiating structure consisting of a passive radiating structure, preferably in the form of frequency-selective surfaces (FSS). The passive radiating structures are formed by (a) structured metal surfaces surrounded by metal-free regions, or (b) cut-outs in a metal film or metal layer. The passive radiating structures consist of a
(Continued)

composite film comprising at least one plastics carrier layer and a metal film or layer attached thereto. The composite film is attached or glued onto the outer surface or outer skin of the radome.

18 Claims, 9 Drawing Sheets

(51) Int. Cl.

| | |
|---|---|
| ***H01Q 19/10*** | (2006.01) |
| ***H01Q 15/00*** | (2006.01) |
| *H01Q 21/26* | (2006.01) |

(56) References Cited

U.S. PATENT DOCUMENTS

| | | | | |
|---|---|---|---|---|
| 6,229,496 | B1 * | 5/2001 | Eriksson | H01Q 1/246 343/789 |
| 7,079,079 | B2 * | 7/2006 | Jo | H01Q 1/243 343/700 MS |
| 7,245,267 | B2 * | 7/2007 | Gottl | H01Q 1/246 343/702 |
| 2002/0089462 | A1 * | 7/2002 | Monzon | H01Q 3/14 343/761 |
| 2005/0062673 | A1 | 3/2005 | Wu et al. | |
| 2007/0001923 | A1 * | 1/2007 | Slattman | H01Q 19/28 343/872 |
| 2008/0010809 | A1 | 1/2008 | Lin et al. | |
| 2011/0316752 | A1 * | 12/2011 | Wu | H01Q 1/243 343/702 |
| 2013/0009846 | A1 | 1/2013 | Freitag et al. | |
| 2014/0118218 | A1 | 5/2014 | Jordan et al. | |

FOREIGN PATENT DOCUMENTS

| | | |
|---|---|---|
| DE | 101 50 150 | 5/2003 |
| DE | 102 17 330 | 5/2003 |
| DE | 10 2005 005 781 | 8/2006 |
| EP | 1 689 022 | 8/2006 |
| JP | 2005-033404 | 2/2005 |
| WO | WO 00/39894 | 7/2000 |

OTHER PUBLICATIONS

Written Opinion of the ISA for PCT/EP2016/053634, dated May 17, 2016, 6 pages.

International Preliminary Report on Patentability for PCT/EP2016/053634, dated Jan. 27, 2017, (German language), 48 pages.

Wikipedia: Kunststofffolie. Online Enzyklopedia, version Oct. 14, 2014, 3 pages.

English translation of the International Preliminary Report on Patentability dated Aug. 31, 2017, issued in corresponding International Application No. PCT/EP2016/053634.

* cited by examiner

RADOME AND ASSOCIATED MOBILE COMMUNICATIONS ANTENNA, AND METHOD FOR PRODUCING THE RADOME OR THE MOBILE COMMUNICATIONS ANTENNA

CROSS-REFERENCE TO RELATED APPLICATIONS

This application is the U.S. national phase of International Application No. PCT/EP2016/053634 filed Feb. 22, 2016; which claims priority to German Patent Application No. 102015002441.8 filed Feb. 26, 2015; and claims benefit of U.S. Provisional Patent Application No. 62/525,269 filed Jun. 27, 2017. Each of these prior applications is incorporated herein by reference as if expressly set forth.

STATEMENT REGARDING FEDERALLY SPONSORED RESEARCH OR DEVELOPMENT

None.

FIELD

The invention relates to a radome and to an associated mobile communications antenna with a radome, and to a method for producing the radome or the mobile communications antenna.

BACKGROUND AND SUMMARY

Mobile communications antennas for base stations typically have a vertically extending conductive reflector which can possibly also be provided with webs, edge boundaries, etc. extending in the longitudinal or vertical direction and being offset outwardly from the center, which are oriented angled or perpendicular to the reflector plane. Arranged in front of the reflector are typically a plurality of radiators, radiator elements or radiator groups arranged offset in the vertical direction, which can transmit and/or receive, for example, in one polarization plane or also in two polarization planes arranged perpendicularly to one another.

Frequently, the dual-polarized radiators are oriented at an angle of +45 deg. or −45 deg. to the vertical (or horizontal), so that they are also referred to as cross-polarization radiators.

The radiators, radiator elements and radiator groups can be arranged in one or more columns adjoining one another. Such antenna arrays comprising a plurality of adjacent columns, however, typically have a combined reflector or a combined reflector sheet.

As radiator elements, all conceivable radiators come into consideration, for example, single-polarized or dual-polarized radiators, dipole emitters or dipole-type radiators, patch radiators, etc. With regard to the different radiator types coming into use, purely by way of example, reference is made to the following previous publications, specifically DE 197 22 742 A1, DE 196 27 015 A1, U.S. Pat. No. 5,710,569, WO 00/39894 and DE 101 50 150 A1.

Such antenna arrangements are typically accommodated in a radome which serves to protect the radiator against weather influences. The radome itself is transparent to electromagnetic waves and typically consists of a glass fiber-reinforced plastics material.

In widely used mobile communications antennas, the radome is typically configured, in the peripheral direction, as a closed complete housing, onto the upper and lower end face of which, corresponding cover caps can be placed. Suitable cable connections for the HF signals and/or to control antenna components (for example, a downtilt angle) can be connected to the underside of the antenna and/or also to the rear side of the antenna.

It is known that mobile communications antennas are typically configured for emitting purely in a particular sector, for example, for a sector of 120 deg., 30 deg. or 180 deg., 30 deg., etc. Therefore, a high front-to-back ratio is often desired, which is to be greater than 20 dB, and often greater than 25 dB or even greater than 30 dB.

In order to achieve a better front-to-back ratio, in a known mobile communications antenna accommodated in a radome (wherein the entire antenna device including the reflector and the radiators, radiator elements or radiator groups building thereon are accommodated in the radome which is closed in the peripheral direction) an additional metal sheet is mounted at a spacing behind the rear side of the radome. In this way, effectively a "double reflector" is formed, so that the front-to-back ratio is improved.

A design of this type is known, for example, from DE 102 17 330 B4. In order to achieve an improvement of the antenna front-to-back-ratio (FTBR) and the front-to-side-ratio (FTSR) and thereby an improved suppression of side lobes, and to screen the radiators better, a second reflector is provided on the rear side of a reflector, at a spacing therefrom and, in a further embodiment, additionally a third reflector at a spacing from the second reflector, behind it. All the reflectors have side webs which rise forwardly from the respective reflector plane in the direction of radiation. This results in a shell structure wherein the outermost reflector encompasses and screens with its side webs the middle reflector, which encompasses and screens the actual reflector carrying the radiators, not only on the rear side, but also laterally.

JP 2005-033404 A1 discloses a radome for an antenna, specifically with reflector side webs which rise from the radome rear side in the direction of radiation. The reflector side webs are provided as panel-like strips on the outer skin of the radome. These panels can also be arranged opposite the rear side of the radome at a particular spacing therefrom on the side wall regions of the radome. It is even possible that these strip-shaped panels are applied at the transition region from the side surfaces of the radome to the front region, so that they must be configured slightly arc-shaped in cross section since here the radome typically transitions via an arc portion from the side wall portion to the front portion.

Finally, in DE 10 2005 005 781 A1 or EP 1 689 022 A1, it was proposed, in a mobile communications antenna with a reflector accommodated integrated into a radome, additionally to provide a further reflector in the form of a conductive surface structure which is incorporated into the rear wall of the radome and/or is situated in the rear wall of the radome.

In that the conductive surface structure according to DE 10 2005 005 781 A1 or EP 1 689 022 A1 is incorporated into the material of the radome, the radome should become lighter (as compared with the prior art in which additionally reflector sheets are separately mounted at a spacing from the radome). In addition, the reflector incorporated into the radome material should be better protected. In particular, in comparison with known solutions in which, for example, reflector devices would be glued onto the radome material, the risk that these reflectors become detached again from the radome material due to the effect of great heat is to be counteracted.

It was also proposed in DE 10 2005 005 781 A1 to provide the aforementioned conductive surface structures in the radome material not only on the rear side and/or in the side wall portions of the radome, but additionally or alternatively also incorporated into the front side of the radome.

According to the previously known prior art, the conductive surface structure incorporated into the radome material is to consist, for example, of a conductive woven structure, in particular a form of a wire woven structure, a hole structure, a grid structure, a linear grating structure or a metal film, which is covered at least on one side and preferably on both sides with a layer consisting of or comprising paper.

It is an object of the present invention to provide a further improved radome and an associated mobile communications antenna with a radome of this type and a method for producing the radome or the mobile communications antenna.

The object is achieved according to the invention in relation to the radome in accordance with the features of claim 1, in relation to the mobile communications antenna in accordance with the features of claim 17, and in relation to the method in accordance with the features of claim 18. Advantageous embodiments of the invention are specified in the dependent claims.

Thus in the context of the invention, therefore passive radiating structures are realized on the surface, that is the outer skin of the radome, in particular in the form of frequency-selective surfaces.

These are preferably arranged periodically on the radome, i.e. particularly, periodically positioned in the longitudinal direction of the radome. In this case, these frequency-selective surfaces can be realized as preferred passive radiating structures, preferably in the form of periodically arranged dipoles or periodically arranged slits (which then form magnetic dipoles). The difference consists in the reflected and transmitted wave. Considering only the transmission, a band-stop filter can be realized with the electric dipoles. Considering only the reflection, a bandpass filter can be realized with the magnetic dipoles.

For the passive radiating structures, particularly in the form of the "frequency-selective surfaces", a wide range of different forms, i.e. different structural forms, can be selected. Forms in the shape of a Jerusalem cross or a hexagonal loop are preferable.

These passive radiating structures can be applied, in a suitable manner, onto the outer skin of the radome. A variant is preferred in which the passive radiating structures are configured on or within the structure of a composite film which, apart from at least one carrier layer, thus comprises a metal film or metal layer.

In the context of the invention, by means of the inventive composite film to be optimally applied and having optimal shielding, an improved intermodulation suppression can be achieved, for example, in relation also to a power cable leading to the antenna. The same applies basically also in relation to a non-intermodulation-capable cable which extends behind the antenna or is mounted in relation to a remote radio head (RRH), which is usually mounted behind the antenna on a mast. In the context of the invention, however, the negative influences on the antenna which are caused, for example, by a mast carrying the antenna, by a cable leading to the antenna, by steel cables mechanically fixing the antenna, etc., can generally also be reduced and prevented. In other words, therefore, the intermodulation suppression and thus the passive intermodulation-proofing (=reduction or suppression of passive intermodulations) can be significantly improved.

Additionally, in the context of the present invention, not only can an improvement of the radiating properties of a mobile communications antenna be realized, for example, through the improved antenna front-to-back ratio or improved side damping, with significantly simpler and, in particular, more economical means, but also suppression of intermodulation is found which in the prior art is caused, for example, by power cables leading to the antenna.

In the same way, by incorporating suitable radiating or slit structures or the like, for example, into the side wall portions of the radome and/or in the front side region of the radome, the radiation pattern can be affected in a targeted manner.

In comparison with the known solutions wherein, for example, a second or third reflector (subreflector) was mounted behind the antenna radome, in the context of the invention, a far smaller structural space is required.

In the solution according to DE 10 2005 005 781 A1 or EP 1 689 022 A1, also, only a small structural space is required since the conductive surface structure in the form particularly of a grid and/or a hole structure is incorporated into the radome material itself. It has been found, however, that such a design is complex and therefore costly, and particularly highly labor-intensive and time-intensive in its production, and additionally inflexible in the individual configuration.

In the context of the present invention, therefore, only a relatively thin composite film is glued onto a metal film or layer on the outer skin of the radome, preferably over the whole surface. This process is easy and economical to perform. Through the gluing of such a composite film onto the outer side of the radome, i.e. onto the outer skin of the radome, by simple means, a second rear reflector improving the shielding is formed, similarly to corresponding second reflector side webs, if the metal film is provided in the side region or additionally in the side region of the radome. It proves to be particularly positive in the context of the invention that the side region can also be individually adapted, which also applies to the dimensioning. In other words, the corresponding composite film can be provided on the radome suitably adapted in the desired width.

If therefore additional, particularly passive, radiating structures serving for beam shaping are realized, these can be configured, for example, as individual conductive surface structures on a plastics film serving as the carrier layer. It is however equally possible that a corresponding metal layer or metal film is provided on a composite film which has cut-outs intended for creating passive radiating structures, for example, slit cut-outs in the metal film or metal layer, wherein at least one plastics carrier layer provided for the metal film extends preferably over the whole area, and thus has no cut-outs in the plastics film material. In other words, a film typically having at least two or more layers and a corresponding metal layer or metal film is glued, as far as possible, full-surface onto the outer skin of the radome, wherein metal area regions are then provided only at particular sites, or not provided at particular sites, to produce the corresponding beam-shaping structures, and such metal-free structures are thus surrounded by corresponding conductive metal areas and are thereby formed.

In a preferred embodiment of the invention, a self-adhesive composite film is used, although the adhesive layer can also be applied separately on the outer side of the radome and/or on the side of the metal film or the film composite to be glued, before the gluing.

The composite film comprising a material film or material layer can have the smallest material thicknesses, for example, less than 1 mm, possibly even less than 0.5 mm.

In a particularly preferred embodiment of the invention, the glued-on composite film is constructed multi-layered and comprises at least one carrier layer aside from the actual metal layer. Preferably, a carrier layer can be provided on each side of the metal layer so that this composite film comprising at least three layers can then be glued by means of an adhesive layer onto the outer skin of the radome.

The carrier layer preferably consists of polyethylene terephthalate (PET). This is therefore a thermoplastic plastics material from the polyester family produced by polycondensation. However, the carrier film can also consist of polyethylene (PE), for example PE-LD (LDPE), that is, strongly branched polymer chains, while producing a relatively low density.

It has proved to be particularly advantageous that during the manufacture of the radome, not only the radome itself can be produced in the context of an extrusion or casting process, but that also the composite film production and/or application onto the radome can be brought about continuously in a pultrusion (drawn extrusion) process.

Summarizing, it can thus be stated that in the context of the invention, best results with regard to an improved shielding and/or with regard to the production of radiator structures, in particular passive radiator structures, can be achieved with the simplest means. In this context, an extremely space-saving solution is proposed, wherein the existing radome assumes the insulating and positioning function for the composite film comprising the metal layer or metal film. All the conventionally required additional parts are rendered unnecessary and an additional space saving within the antenna is achieved, where, in the prior art, separate additional space-occupying shielding parts had been used. In contrast to the surface structures themselves incorporated into the radome material, the inventive solution can be realized much more simply and effectively. Particularly in that the film can be glued or generally applied without problems on all desired regions, for example, over the entire length of the radome and also as far as desired into the side regions, in particular, an optimum shielding in the rearward and/or lateral region of the radome can be achieved far less problematically as compared with conventional solutions in relation, also, to the conductive surface structure incorporated into the radome material, so that not only can, in general, an improved antenna front-to-back ratio, an improvement in the lateral damping, and an easier field pattern form be achieved, but above all also an optimum shielding, for example for a remote radio head (RRH), as is nowadays often separately provided between the rear side of the radome and, for example, an antenna mast.

It has proved to be positive that for different uses or antenna embodiments, the composite film can be cut to size and placed as desired. It is also possible to choose from a selection of different films which are respectively optimized for the specific utilization cases.

BRIEF DESCRIPTION OF THE DRAWINGS

The invention will now be described in greater detail by reference to examples. In the drawings.

DETAILED DESCRIPTION OF NON-LIMITING EMBODIMENTS

Figure 1:
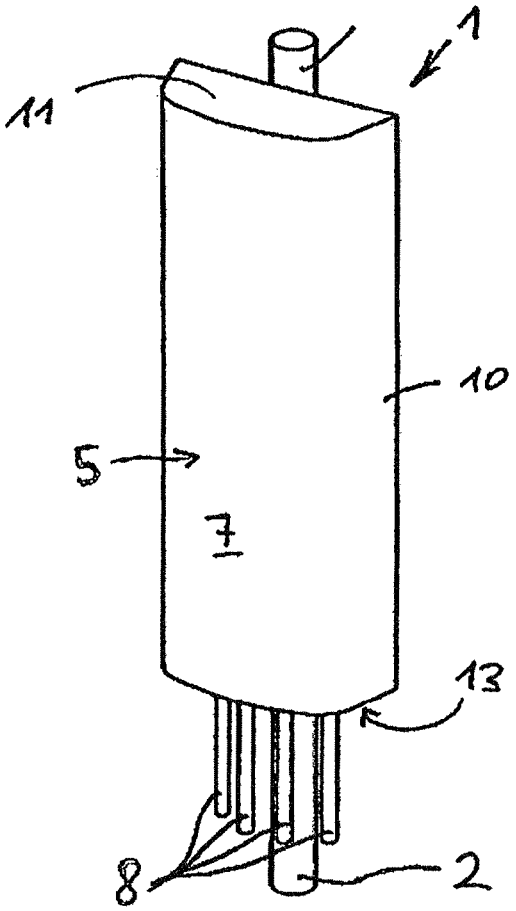
FIG. 1 is a schematic perspective view of a mobile communications antenna with a radome, which is attached to a mast.

FIG. 1 schematically shows a mobile communications antenna 1 which belongs, for example, to a base station. The mobile communications antenna 1 is held and adjusted, for example, by means of a mast 2. The mobile communications antenna 1 comprises in the interior a reflector 3 (not yet visible in FIG. 1), in front of which typically a multiplicity of radiators, for example, dipole radiators, patch radiators, etc. are arranged offset to one another in the vertical direction.

The radiators can be any suitable radiators, radiator elements or radiator groups, as known in principle, for example, from the previously published DE 197 22 742 A1, DE 196 27 015 A1, U.S. Pat. No. 5,710,569, WO 00/39894 or DE 101 50 150 A1.

The radiators, radiator elements or radiator groups are accommodated protected under a radome 5, the radome 5 typically being manufactured as a one-part body which is closed in the peripheral direction and comprises a somewhat convexly curved front side 7, side wall portions 10 and a typically rather flat rear side 9. An upper cover cap 11 is placeable and fastenable on the top side and on the bottom side, a corresponding lower closing cap 13 (FIG. 1). However, the lower closing cap 13 often consists of a metal flange to which the electrical connections for the radiators arranged within the antenna or the other control devices are provided in order, for example, to adjust a downtilt angle, etc. differently. In FIG. 1, cables 8 which lead to the connections at the underside of the antenna cover are drawn in. In this regard, reference is made to known solutions.

Figure 2:
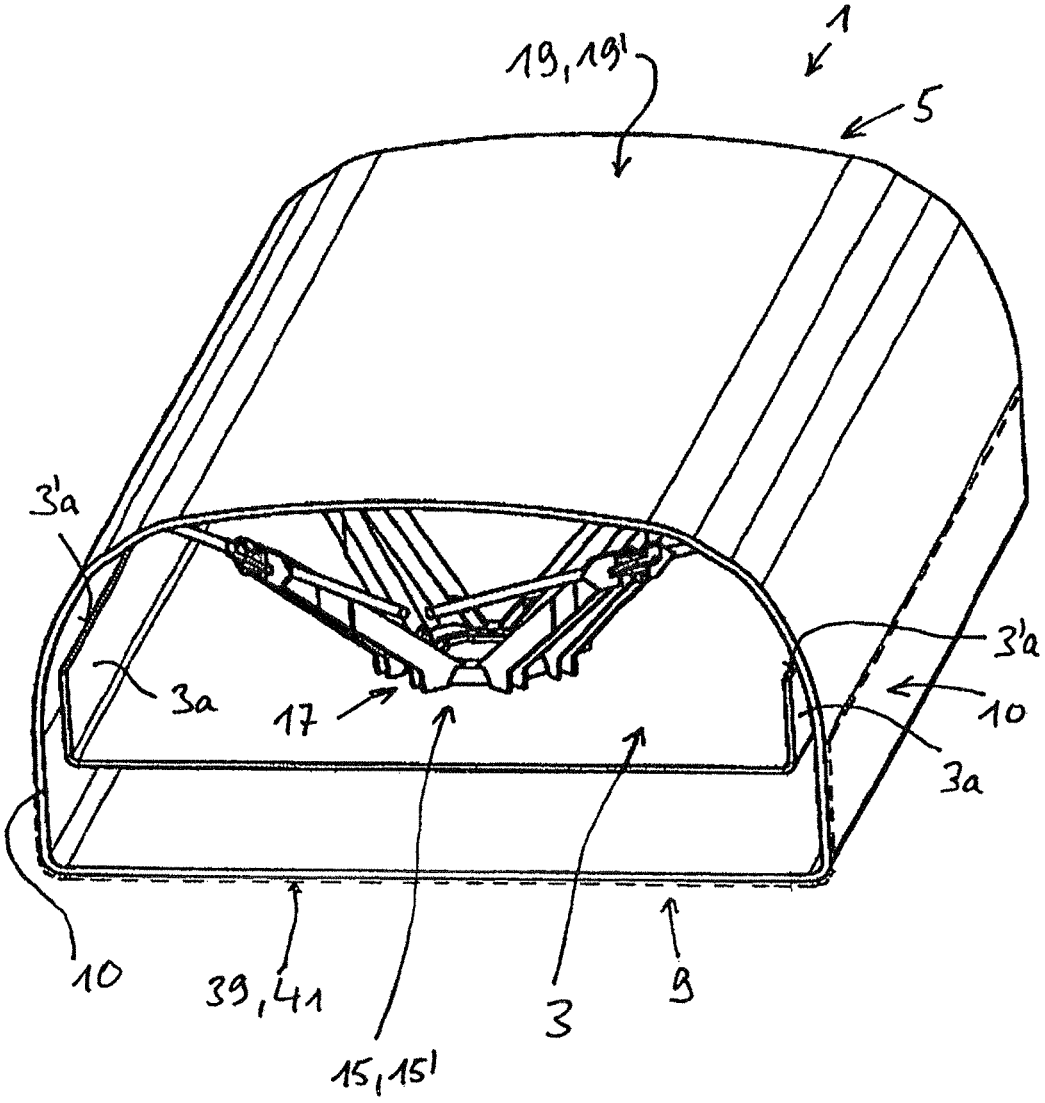
FIG. 2 is a schematic perspective sectional view of an antenna with an inventive radome and with, glued onto the outer skin of the rearward side and on a subregion of the side wall portions of the radome, a composite film which comprises a metal layer.

In FIG. 2, a perspective partial sectional representation of the mobile communications antenna is visible, specifically with a radome closed in the peripheral direction, within which a conductive reflector 3 is accommodated. This typically consists of metal or metal sheet. The reflector 3 can also comprise two reflector side wall portions or side wall webs 5*a* (reflector side wall webs) which extend in the longitudinal direction and therefore typically, with corresponding orientation of the antenna, in the vertical direction and can thus be placed vertically or at an angle deviating therefrom in relation to the reflector plane RE.

Arranged in the longitudinal direction of the reflector, spaced apart from one another are the suitable or desired radiators 15 for the mobile communications field, which can radiate, i.e. transmit and receive, in one polarization plane or in two polarization planes. The radiators can transmit and/or receive, for example, in a single band or in a dual-band or multi-band mode.

FIG. 2 shows, in a perspective partial view, a single dual-polarized radiator 15 which consists of a dipole square 15' and is mounted via an associated carrier 17 on the reflector 3.

FIG. 2 shows, in a perspective partial view, a single dual-polarised radiator 15 which consists of a dipole square 15' and is mounted via an associated carrier 17 on the reflector 3.

Figure 3:
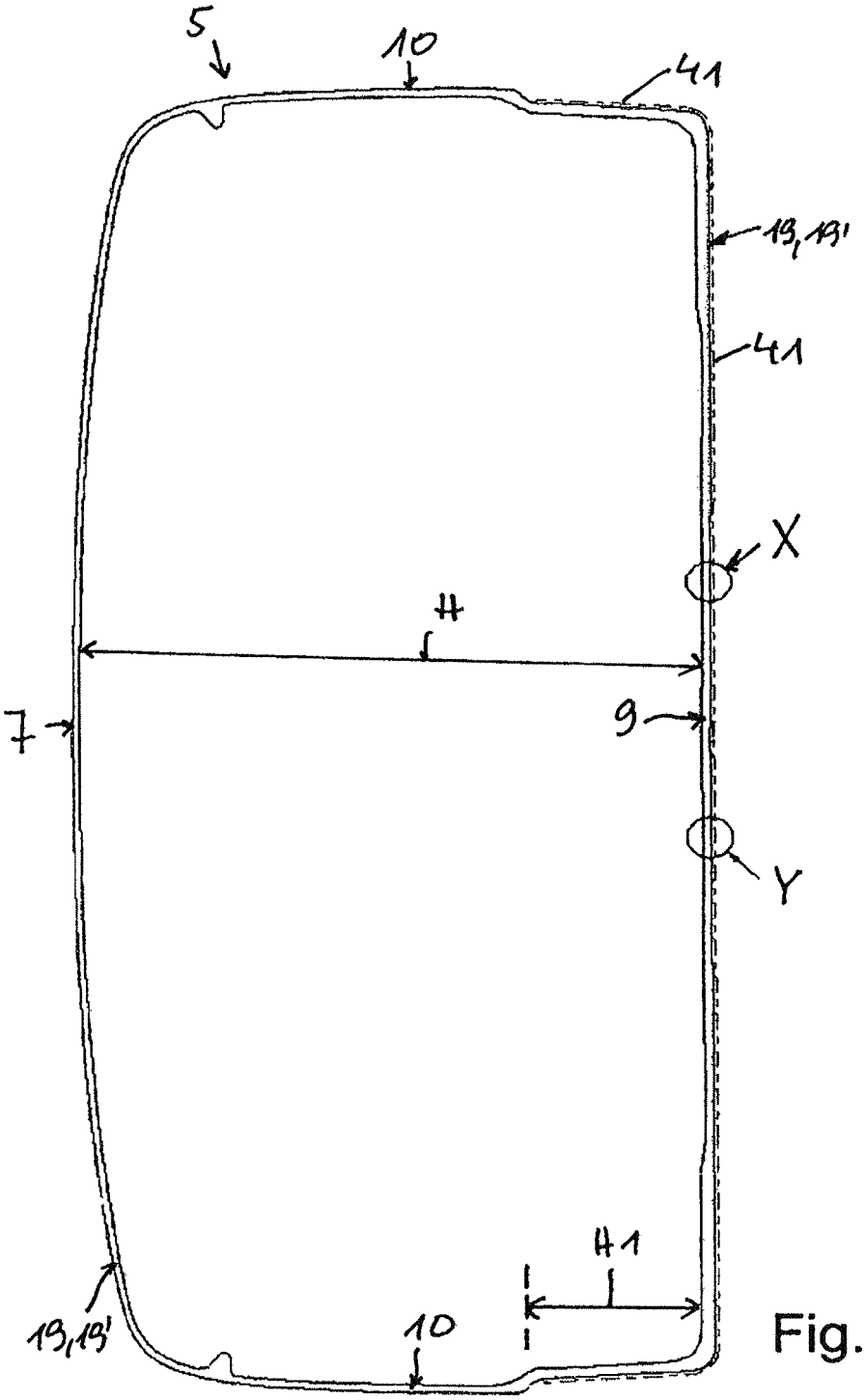
FIG. 3 is a cross section through an inventive radome as part of a mobile communications antenna.

As shown, in particular, by the cross-sectional view of FIG. 3, the aforementioned conductive surface structure 39 in the form of a composite film 41 which comprises a metal layer or film can now be applied to the outer side 19 of the radome, i.e. the outer skin 19', over the whole area or in subregions. The corresponding composite film 41 is indicated dashed in the cross-sectional view of FIG. 3.

As is also indicated in the cross-sectional view of FIG. 3, the aforementioned composite film 41 with the included metal layer or metal film can be configured, for example, full-surface on the rear side 9 and/or on the side wall portions 10 of the radome 5 at least in a partial height region H1 relative to the overall height or overall thickness H (starting from the rear side 9 of the radome), as shown dashed in the cross-sectional view of FIG. 3. Due to the application of the composite film on the radome on the outer side 19, no warping occurs here. In addition, the metal structures in the composite film are optimally placed. Since the composite film can also be configured as desired regarding its color design, there is the added advantage that the optical impression of the antenna can be specifically changed by means of a desired design and/or by a preferred shaping of the film.

Figure 4:
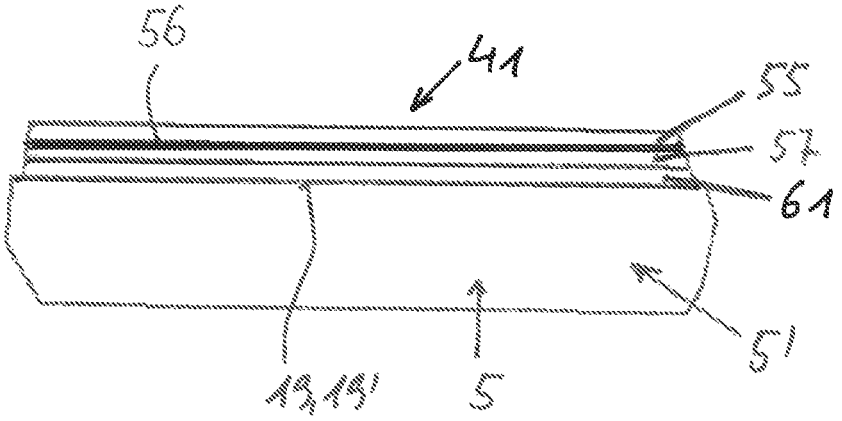
FIG. 4 is a partial cross-sectional view through the composite film glued onto the rear side of a radome and comprising a metal film.

In FIG. 4, a possible structure of the cut-out X shown in FIG. 3 is reproduced in an enlarged partial cross section which partially shows the composite film 41, as it is glued onto the rear side 51 of the radome 5.

In the partial cross section, for example, the profiled part 5' of the radome 5 is shown, as formed, for example, on the rearward side 9 of the radome 5. Glued thereon is the aforementioned composite film 41 which comprises externally, that is, opposite to the radome 5, a plastics carrier layer 55, following this, the electrically conductive metal layer 57 and subsequently thereon, an adhesive layer 61 by means of which the composite film 41 thus formed is glued onto the material or the profiled part 5' of the radome 5.

Figure 5:
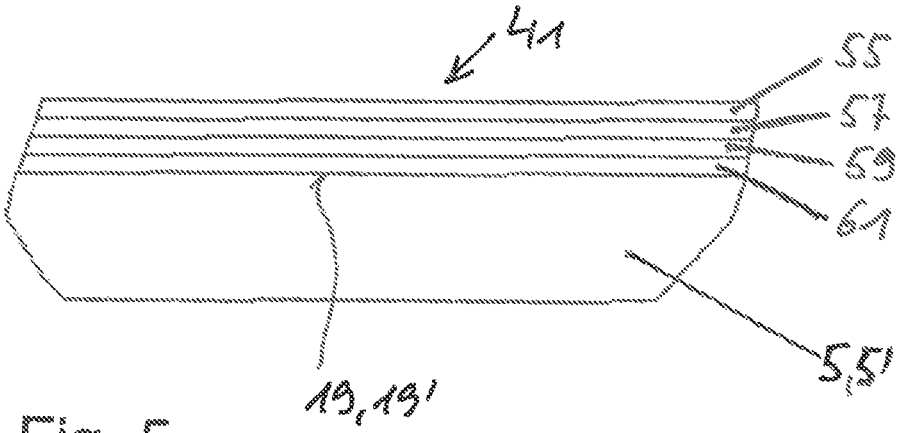
FIG. 5 shows an embodiment derived from FIG. 3.

The cross-sectional view of FIG. 5 (which reproduces the portion Y in FIG. 3, enlarged) shows that the structure can also be such that, moving from outside towards the outer skin 19 or the upper surface 19' of the radome 5, the composite film 41 is constructed so that firstly an outward plastics carrier layer 55 is provided, on which on the side lying facing the radome 5, a metal layer 57 follows, on which a further plastics carrier layer 59 is subsequently provided, which is then glued via the aforementioned adhesive layer 61 onto the outer surface 19' of the radome 5.

The conductive metal layer 57 can consist, for example, of a copper layer, a brass layer, an aluminum layer or a tin or zinc layer. Preferably, the metal layer or metal film 57 consists of a material that has no steel or iron, thus of a rust-free material.

The plastics carrier layer 55, 57, in particular the outermost plastics carrier layer 55 can consist, for example, of polyethylene terephthalate (PET, PETP), thus of a thermoplastic plastics material produced by polycondensation, preferably from the family of polyesters.

The optionally provided second plastics carrier layer lying closer to the radome material can consist, for example, of polyethylene (PE), that is, a thermoplastic material produced by polymerization of ethene. In this case, preferably PE-types such as PE-LD (LDPE) are used, although other PE types can also be considered, for example PE-LD (LDPE): strongly branched polymer chains with low density (LD);

PE-HD (HDPE): weakly branched polymer chains (HD=high density);

PE-LLD (LLDPE): linear polyethylene of low density, the polymer molecule of which has only short branches (LLD=linear low density);

PE-HMW: high molecular weight polyethylene (HMW=high molecular weight);

PE-UHMW: ultrahigh molecular weight HDPE with a medium molar mass (UHMW=ultrahigh molecular weight).

It is therefore apparent from this that the composite film is fundamentally a two or three-layered film, although the company preferably provides it with a further layer, specifically the glue layer 61. It can thus also be considered a self-adhesive composite film 41.

Depending on the production, a further bonding agent layer can be provided between the respectively aforementioned plastics carrier layer and the metal layer, although it is significantly thinner relative to the individual plastics carrier layer or metal layer.

The overall construction of the composite film 41 thus formed can be such that its thickness is less than 1 mm, in particular less than 0.9 mm, 0.8 mm, 0.7 mm, 0.6 mm, 0.5 mm, 0.4 mm, 0.3 mm or 0.2 mm.

In the embodiment shown in FIG. 2, the aforementioned composite film 41 comprising the metal layer 57 is glued on as far as into the side wall region 10 of the radome 5, extending onto the outer skin 19' of the radome. The adhesive layer ends here, for example, approximately at a height relative to the reflector plane RE of a reflector 3 mounted within the radome 5, which comes to lie, for example, at the position of the free web edges 3'*a* of the reflector side webs 3*a*. However, the composite film can end at a greater or lesser spacing from the reflector plane RE, that is, deviating from the height of the free ending web edges 3'*a* of the side webs 3*a* of the reflector 3.

Figure 6:
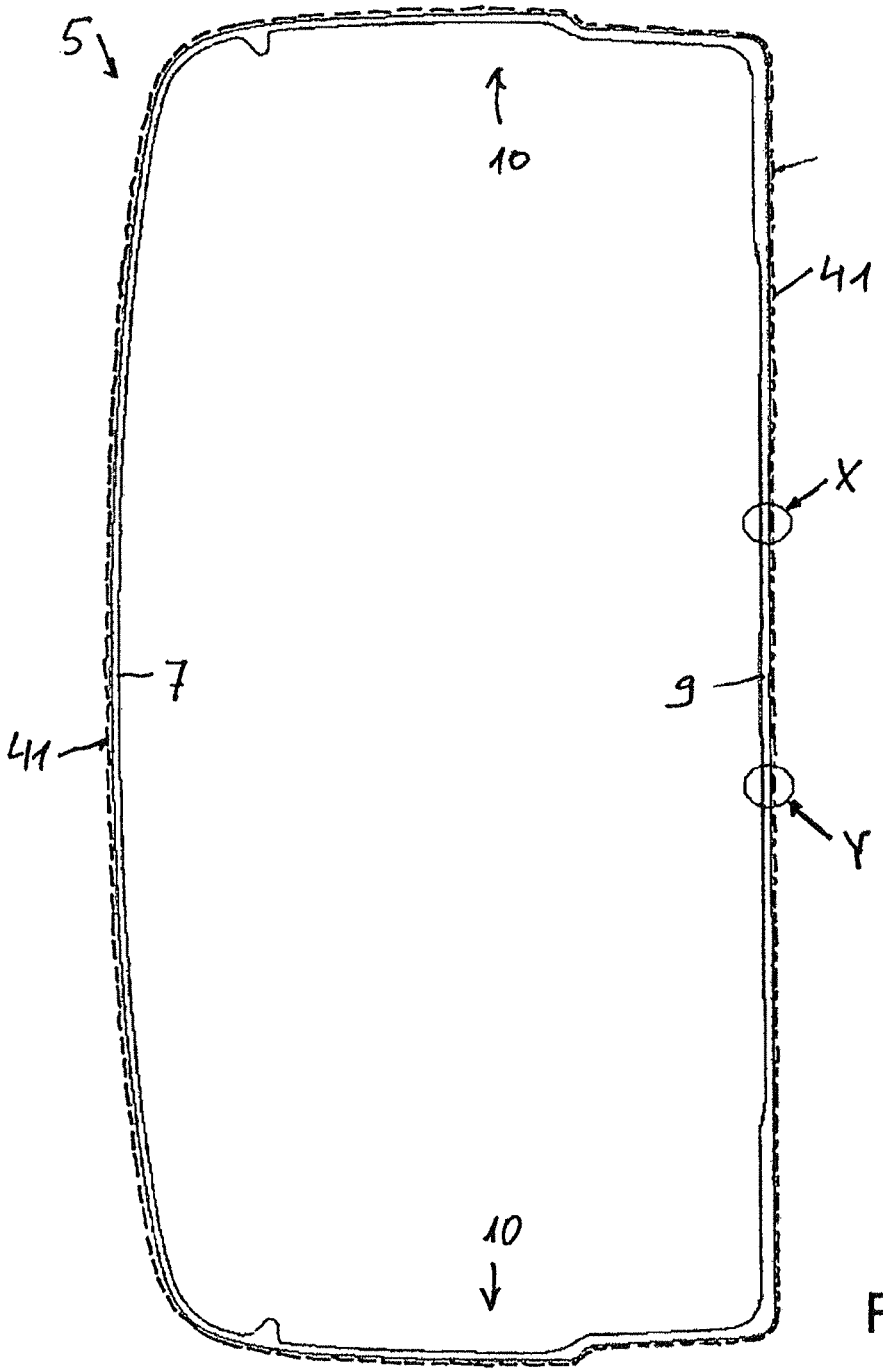
FIG. 6 is a further cross-sectional view through a radome comparable with the sectional view of FIG. 3.

It is therefore also possible, as shown for example by the cross-sectional view of FIG. 6, that the composite film 41 comprising the metal film or metal layer 57 covers still greater regions of the side wall portions 10 of the radome at the outer skin or is even glued peripherally round the whole radome.

It should also be emphasized that in the context of the invention, a targeted application of the composite film is possible, i.e. a precise placement and orientation, that is, in a pre-selectable position relative to the radiator elements in the antenna. In other words, the corresponding structures in the film can be precisely placed at the sites where they can cooperate optimally with the radiators situated below the radome.

Furthermore, the radiator elements and/or the composite film 41 can be provided with or without radiating structures (discussed in more detail below) arranged asymmetrically and/or only on one side of the radome or, typically, symmetrically on both sides of the radome.

The composite film 41 described can preferably be glued on during a pultrusion (drawn extrusion) process, integrated during the corresponding production of the radome. The advantage of such a pultrusion process is that thereby a radome with a glued-on composite film 41 can be produced in an effectively endless process. Finishing process steps or additional further work steps are also avoided.

However, it should be mentioned that the film application can also take place in a further process step. In this case, the composite film 41 to be glued on would be cut to size in a suitable manner and applied i.e. glued onto the radome, for example, with a rolling mechanism. Preferably, this is again a self-gluing or self-adhering composite film 41. It is however also possible that the outer skin or outer surface 19' of the radome 5 is provided with an adhesive layer (for example, an adhesive layer is sprayed onto the outer skin 19' of the radome) before the plastics-metal film 41 is then glued on. Additionally or alternatively, a glue or adhesive layer can initially also be applied onto the side of the composite film 41, by means of which the composite film 41 is then to be glued onto the outer skin 19' of the radome 5.

A further advantage of a plastics-metal film composite 41 configured thus is that the particularly outwardly arranged plastics carrier layer 55 is not only transparent, but can also be configured colored. A possibility is even the application of particular printed images. By this means, the external design of a radome could additionally be configured with the least effort, for example, differently colored or with any desired patterns, printed contours, etc. Advertising could also be printed thereon. Additionally, depending on the corporate presence of the individual mobile communications operators, the individual mobile communications antennas could also be provided with their logos or typically used colors to signal their origin.

It has already been described, by reference to FIG. 6, that the composite film mentioned can, for example, surround the entire radome in the peripheral direction.

Figure 7A:
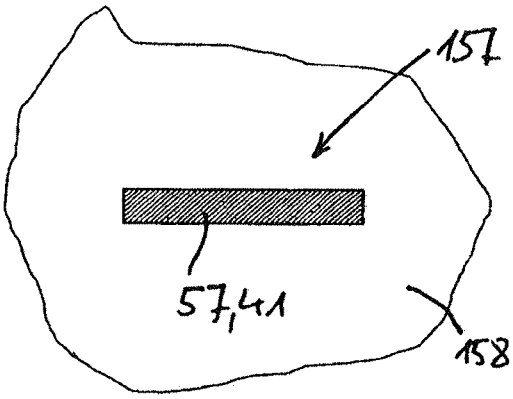
FIGS. 7*a* and 7*b* are partial views of the composite film glued onto the outer skin of a radome which comprises metal-free portions, such that electrically conductive structures remain.
Figure 7B:
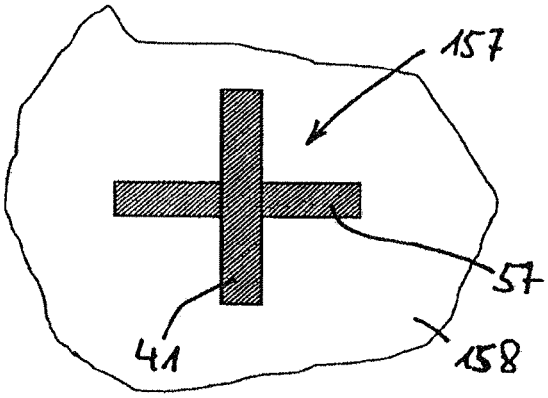

Particularly in this latter case, if the composite film 41 is glued around the entire radome 5 or, for example, only on the front side 7 and/or on the side wall portions 10, the composite film with the at least one plastics carrier layer 55 or, for example, the at least two plastics carrier layers 55 and 57 could additionally comprise no full-surface closed metal layer or metal film 57, but only metal layer portions or structures 157. These metal layer portions or structures 157 could have, as shown in FIGS. 7*a* and 7*b*, for example, rectangular or cruciform metal structures 157 which are surrounded by a metal surface-free region 158. By this means, therefore, slit-shaped or cruciform slit-shaped radiator structures, in particular passive radiator structures can be realized, particularly on the front side of the radome. But also in the side wall portions 10, preferably slit-shaped radiator structures, which serve for targeted beam shaping, can thereby be formed.

Figure 8A:
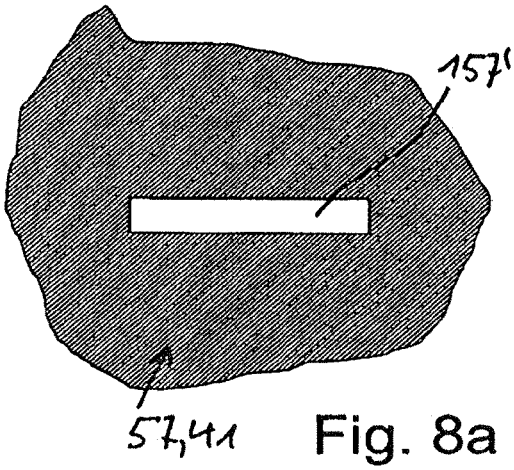
FIGS. 8*a* and 8*b* are views corresponding to FIGS. 7*a* and 7*b*, although the corresponding preferably passive radiating structures are formed by portions in the metal film region that are configured metal-free.
Figure 8B:
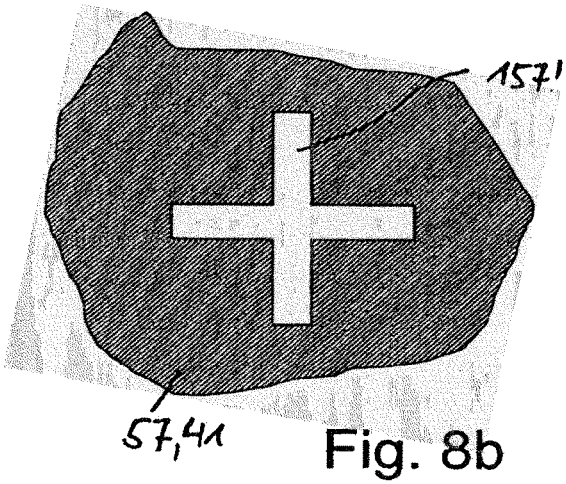

In the variant shown partially in FIGS. 8*a* and 8*b*, the composite film 41 is constructed so that the metal layer 57 is preferably configured effectively almost full-surface, but so that cut-outs 157' are formed in this full-surface metal layer, for example, again slit-shaped or cruciform slit-shaped cut-out structures 157', by which means also, particular passive radiator structures can be created. Such passive radiator structures are suitable, particularly, for use in the side wall region 10 of the radome 5.

Thus, whereas the metal film or metal layer 57 of the composite film 41 is provided mainly on the rear side 9 and/or in side wall regions 10 of the radome 5 in order here to achieve an optimum shielding, the aforementioned electrically conductive surface structures 157 which are relatively small in relation to the metal-free remaining portions 158 of the composite film can preferably be provided on the upper or front side 7 of the radome 5. Slit-shaped structures, preferably also in the form of cut-outs 157' (which are formed at least in the metal layer alone, but which can also be formed in the entire composite film, and thus penetrate all layers of the composite film) can preferably be implemented in the side wall portions 10 of the radome.

It will now be described how, in the context of the inventive design of the mobile communications antenna or the inventive design of the radome, further or alternatively other structures can be provided which ultimately serve for beam shaping.

In this regard, it has already been shown on the basis of examples in the preceding FIGS. 7*a* to 8*b*, how the aforementioned composite film 41 can be used in order to form frequency-selective structures and/or surfaces (FSS), so that antenna parameters of, for example, a base station antenna can be improved. In this case, conductive periodic structures are preferably provided. In FIGS. 7*a* to 8*b*, merely individual structures are shown, which are typically arranged periodically repeating in the longitudinal direction of the radome, in particular in the side wall region 10, adjacent thereto at the lateral edge of the front side 7 or, for example, additionally or alternatively in the immediate transition region from the side wall region 10 to the front side 7, that is in each region where the radome typically has a relatively strong curvature.

In the realization, in particular, of frequency-selective structures and/or surfaces (FSS)—as previously described in relation to FIG. 7*a*, 7*b*, in contrast to FIG. 8*a*, 8*b*—in principle two different configurations are to be distinguished. Possible, specifically, is the construction and use of periodically arranged dipoles, and periodically arranged slits (magnetic dipoles).

The difference between the two variants consists in the reflected wave and the transmitted wave.

Figure 9A:
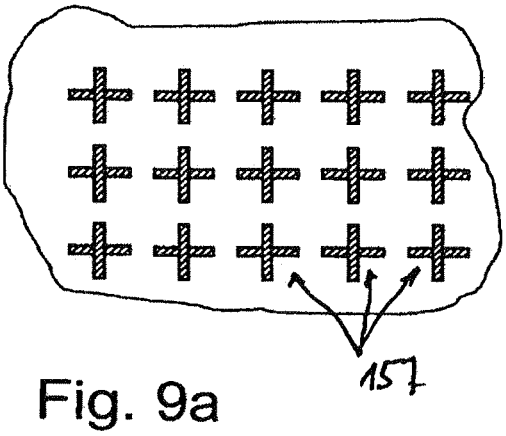
FIG. 9*a* is a view of passive radiating structures on the radome, using periodic electric dipoles.
Figure 9B:
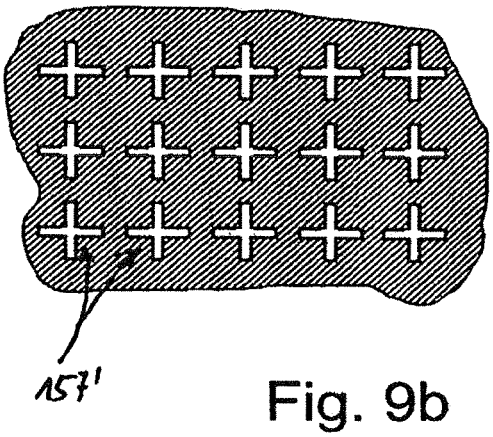
FIG. 9*b* is a view of passive radiating structures on the radome, using periodic magnetic dipoles.

Considering only the transmission, a band-stop filter can be created with the electric dipoles and a bandpass filter with the magnetic dipoles. For this purpose, merely in principle, reference is made to the accompanying FIGS. 9*a* and 9*b*, FIG. 9*a* showing schematically the use of periodic electric dipoles (that is, conductive structures 157) and FIG. 9*b* showing the use of periodic magnetic dipoles (that is, slits 157').

The optimum size of the structures to be used is dependent, firstly, on the frequency (operating frequency of the corresponding mobile communications antenna) and the form of the structures used.

Different examples for possible passive radiating structures will now be described by reference to FIGS. 10*a* to 12*c*. Through the selection of the structure, a particular narrow-band or broad-band radiator design can be achieved.

Figure 10A:
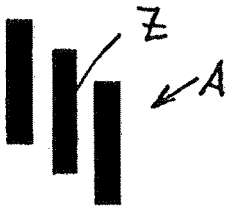
FIGS. 10*a* to 10*c* show a first group A of rotationally symmetrical passive radiating structures.
Figure 10B:
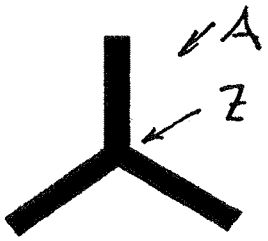
Figure 10C:
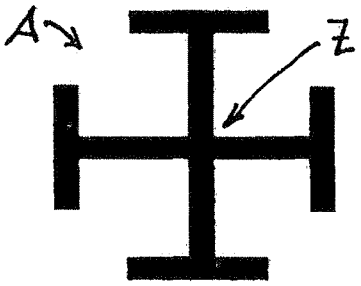

In FIG. 10*a* to 10*c*, a first group of frequency-selective structures is shown in principle, all of which have a common center Z and thus are designated a center-bound structural form A.

Figure 11A:
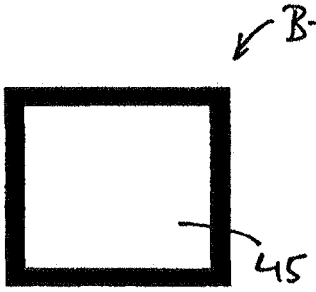
FIGS. 11*a* to 11*c* show a second group B of passive radiating structures in loop form enclosing an interior space.
Figure 11B:
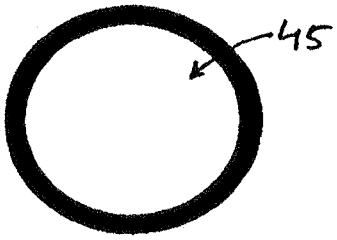
Figure 11C:
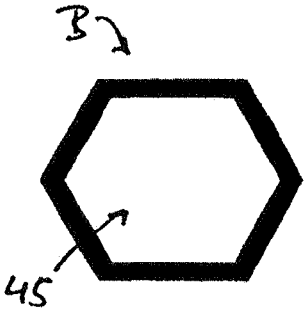

FIG. 11*a* to 11*c* show a second group of the frequency-selective structural form B which are designated loop structures since they surround an inner space 45. These loop structures (or "loop types") are generally smaller than the structural forms A ("center connected types") described above and have the further advantage that they can be applied together as a group. These structural forms B typically have dimensions such that the size of this structural form preferably lies in a particular relation to the wavelength, preferably to the mean operational wavelength of the frequency band to be transmitted, for example, a multiple of $\lambda/2$ in relation to the operational wavelength or the mean operational wavelength.

Figure 12A:
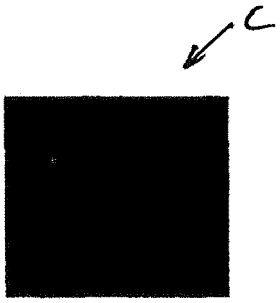
FIGS. 12*a* to 12*c* show a third group C of passive radiating structures with a full-surface interior space.
Figure 12B:
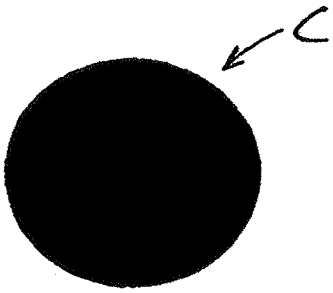
Figure 12C:
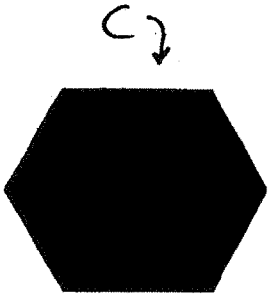

In FIGS. 12*a* to 12*c*, areal structure forms C are shown, specifically in the form of a regular n-polygon or, for example, a circle or disc form wherein the whole inner surface is thus completely closed.

Furthermore, variants are possible involving combinations of the above-mentioned structural forms A, B and/or C with further derivations and forms which thus can be partially or entirely enclosed, some being configured double-walled, etc. It is also possible that the mixed forms of the different structural forms mentioned can also be arranged in one another or interlaced with one another, so that a respectively desired different beam shaping can be achieved for different frequency ranges.

From the structural forms described, it can be seen that many of these structural forms mentioned and shown have a point-symmetrical structure for the formation of frequency-selective surfaces FSS, that is, relative to a central axis Z1 passing centrally through the structural form. In this case, the first group A of the frequency-selective surface structure is configured rotationally symmetrical, specifically with a repetition period of 90° or 120°.

The hexagonal structures have not only a 120° rotational symmetry, but a 60° rotational symmetry. The circular or disc-shaped structures are configured point-symmetrical, that is, rotationally symmetrical overall.

Figure 13:
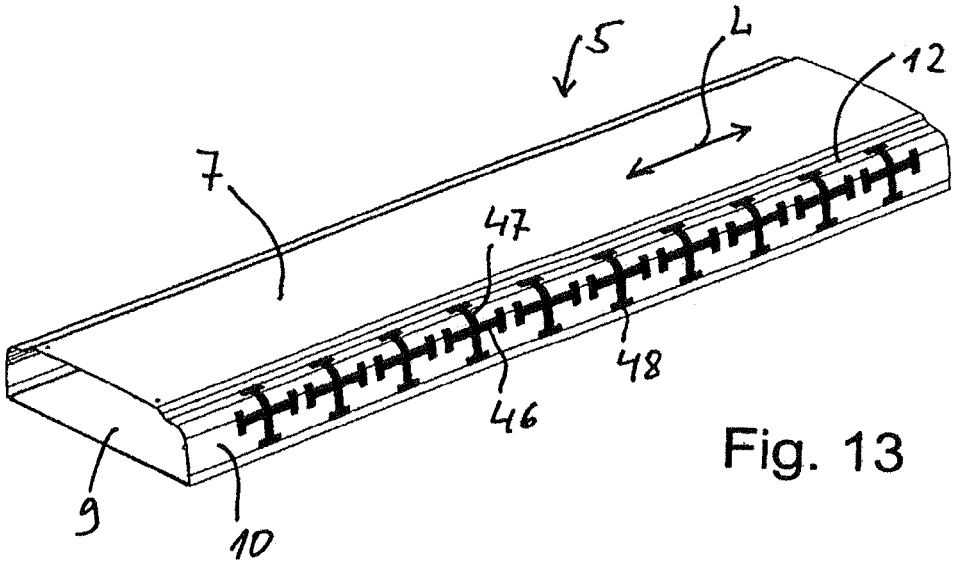
FIG. 13 is a view of periodically arranged passive radiating structures which start in the side wall region of the radome and extend over the curve region as far as the adjoining edge region of the front side.

Making reference to FIG. 13, the construction of a radome will be described in greater detail, wherein in the representation in FIG. 13 in the transition region from the side wall region 10 to the adjacent front side region 7 of the radome 5, as the frequency-selective surface structure FSS, for example, a Jerusalem cross is used, which is arranged at a periodic spacing in the longitudinal direction of the radome, each offset from the next. This is the representation which corresponds to FIG. 10*c* and is shown enlarged in an individual representation in FIG. 13*a*.

It is clear herefrom that one axis 46 of each Jerusalem cross extends in the longitudinal direction of the radome and the axis 47 extending at 90° perpendicularly thereto extends exactly transversely and thus perpendicularly to the longitudinal axis of the radome. A short transverse bar 48 is formed at each end of this cruciform structure.

Figure 14:
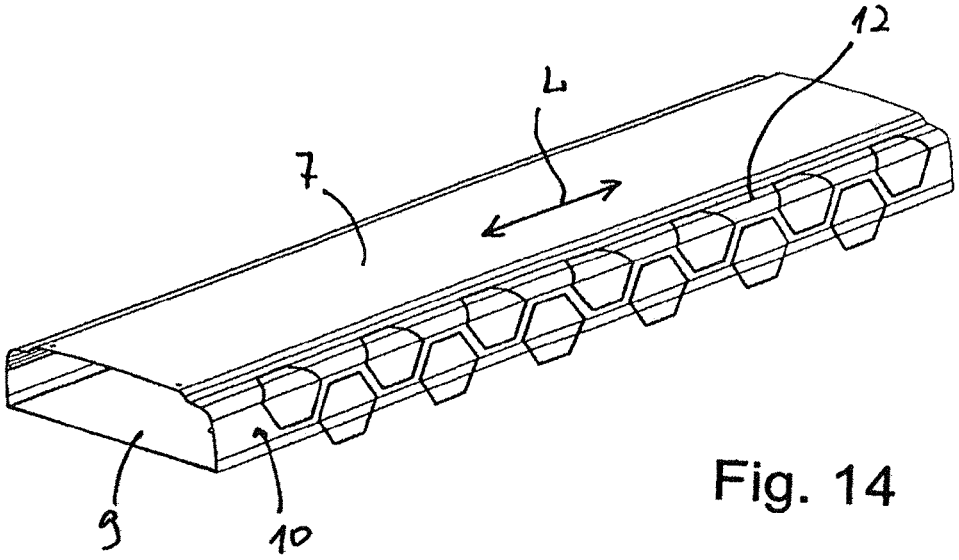
FIG. 14 shows an embodiment derived from FIG. 13 using periodically arranged hexagonal loop structures.
Figure 14A:
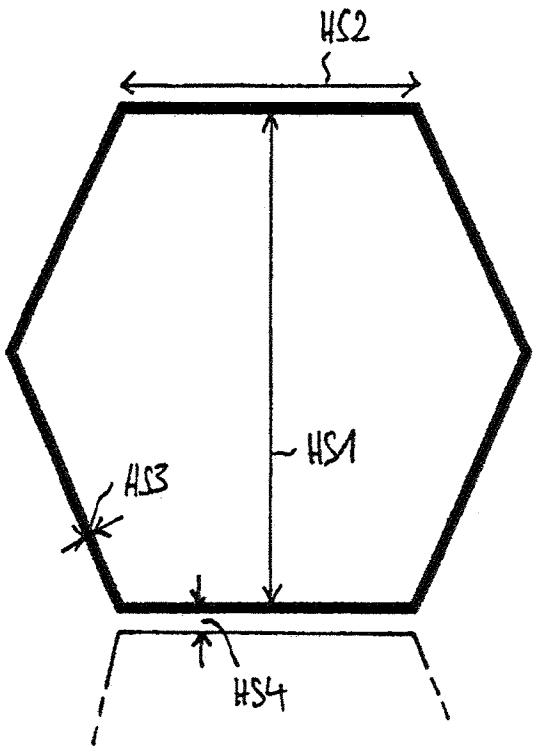
FIG. 14*a* is an enlarged detailed view of the hexagonal formed passive conductor structure, as used in FIG. 15.

FIG. 14 shows a different example, specifically using a hexagonal loop structure, as shown in FIG. 11*c* and in an enlarged representation in FIG. 14*a* (the lower portion of the hexagonal loop structure could be restricted to the side surface or a part could be turned onto the rear side of the radome).

This hexagonal structure is also configured in the longitudinal direction at the transition region from the side wall 10 to the adjacent front side 9 via the edge-like curvature region 12 formed therebetween in the longitudinal direction of the radome 5, wherein the arrangement of this honeycomb-like hexagonal loop structure has been undertaken so that the individual periodically arranged frequency-selective surface structures FFS are arranged offset not only in the longitudinal direction L of the radome, but each successively with a slight lateral offset, as shown in FIG. 15. In other words, in each case, a preceding hexagon and a following hexagon are arranged relative to a hexagon therebetween such that the preceding and the following hexagon structure form an angle of 120° with one another.

The corresponding structures 157 can be configured as conductive structures which are formed in the composite film 41, i.e. on the at least one plastics carrier layer 55, 59. These conductive structures are therefore situated in a surrounding region on the at least one plastics carrier layer 55, 59 which is otherwise formed entirely or largely metal layer-free.

It is also possible that the structure 157' is configured, as mentioned, not as an electrically conductive and thus periodic electric dipoles, but as slit-shaped cut-outs 157' and thus as periodic magnetic dipoles. In this case, the metal layer 57 would also be present in the transition region shown from the side wall region to the adjacent front region of the radome, wherein in this metallic conductive layer the correspondingly mentioned structures are provided according to FIG. 13 or 14 as slit cut-outs 157'.

Furthermore, the structures mentioned can also be relatively tightly packed in order to enhance the filter effect. Thus, for example, the aforementioned cruciform structures can also be positioned very close to one another without touching. In particular, if the Jerusalem cross is used as a structure, the corresponding structures can be arranged by offsetting so that the above greater arrangement density is achieved.

The size of the structures including the conductor width can be varied within broad ranges, and particularly adapted to the frequency range used with the mobile communications antenna.

With regard to the Jerusalem cross of FIG. 14*a*, values for the individual metal surface portions are given below, and these can vary, for example, between the following values:

JK1: 10 mm to 100 mm, in particular 20 mm to 80 mm or 30 mm to 60 mm, in particular approximately 40 mm.

JK2: 10 mm to 100 mm, in particular 20 mm to 80 mm or 30 mm to 60 mm, in particular approximately 40 mm.

JK3: 0.5 mm to 40 mm, in particular 5 mm to 30 mm, in particular 8 mm to 20 mm, in particular 10 mm to 14 mm.

In other words, the lower limit with regard to this dimension can be placed so that the corresponding dimension is at least 0.5 mm and preferably more than 1 mm, 2 mm, 3 mm, 4 mm, 5 mm, 7.5 mm, 10 mm, 12.5 mm, 15 mm, 17.5 mm, 20 mm, 22.5 mm, 25 mm, 27.5 mm, 30 mm. Conversely, favorable uses result if the corresponding dimension is smaller than 40 mm, in particular smaller than 37.5 mm, 35 mm, 32.5 mm, 30 mm, 27.5 mm, 25 mm, 22.5 mm, 20 mm, 17.5 mm, 15 mm, 12.5 mm, 10 mm.

Figure 15B:
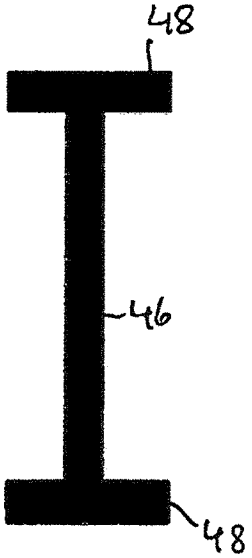
FIGS. 15*a* and 15*b* show further simplified embodiments of fundamentally possible passive radiating structures.
Figure 15A:
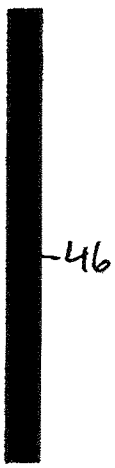

With regard to the hexagonal loop structure according to the representation of FIG. 15*a*, a hexagonal frequency-selective surface structure FSS can be used which has a diameter between two parallel opposite sides with the following values:

HS1: 10 mm to 200 mm, 70 mm to 120 mm, in particular 80 mm to 100 mm. In other words, the dimension can preferably be more than 10 mm, in particular more than 15 mm, 20 mm, 25 mm, 30 mm, 35 mm, 40 mm, 45 mm, 50 mm, 55 mm, 60 mm, 65 mm, 70 mm, 75 mm, 80 mm. On the other hand, preferred dimensions should be smaller than 80 mm, 75 mm, 70 mm, 65 mm, 60 mm, 55 mm, 50 mm, 45 mm, 40 mm, 35 mm, 30 mm, 25 mm, 20 mm.

HS2: 1 mm to 40 mm, in particular 5 mm to 30 mm. In other words, the corresponding dimension for HS2 should be preferably more than 2 mm, in particular more than 3 mm, 4 mm, 5 mm, 7.5 mm, 10 mm, 12.5 mm, 15 mm, 17.5 mm, 20 mm, 22.5 mm, 25 mm, 27.5 mm, 30 mm. Conversely, it can prove favorable if the corresponding dimension is preferably smaller than 35 mm, 32.5 mm, 30 mm, 27.5 mm, 25 mm, 22.5 mm, 20 mm, 17.5 mm, 15 mm, 12.5 mm, 10 mm, 7.5 mm, 5 mm, 2.5 mm.

HS3: 0.5 mm to 20 mm, in particular 0.8 mm to 15 mm or 1 mm to 1.6 mm. In other words, the dimension for HS3 should be preferably more than 1 mm, 2 mm, 3 mm, 4 mm, 5 mm, 7.5 mm, 10 mm, 12.5 mm, 15 mm, 17.5 mm. It is then advantageous if the corresponding dimension is smaller than 17.5 mm, 15 mm, 12.5 mm, 10 mm, 9 mm, 8 mm, 7 mm, 6 mm, 5 mm, 4 mm, 3 mm, 2 mm.

HS4: the gap spacing HS4 to an adjacent hexagonal loop structure can preferably vary between 3 mm and 20 mm, in particular 8 mm and 15 mm, preferably 10 mm and 14 mm.

The structures described are configured, as mentioned, within the composite film 41 so that the composite film, as described in relation to the other exemplary embodiments, is glued on in a pultrusion process (or drawn extrusion) or separately subsequently, for example, preferably using a roller mechanism on the surface or outer side of the radome, in a targeted manner in particular selectively definable regions of the outer side of the radome or surrounding the radome full-surface.

Figure 13A:
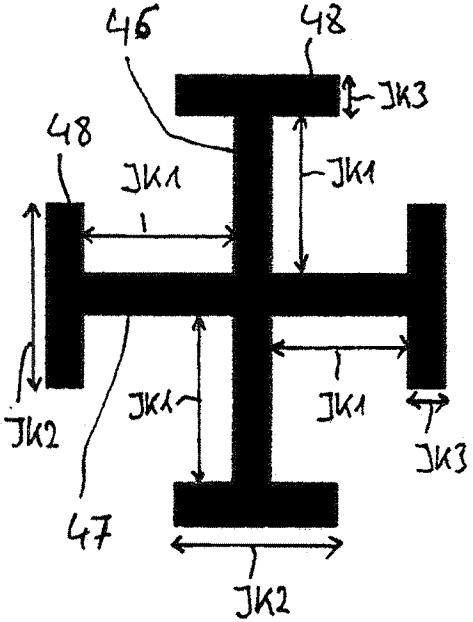
FIG. 13*a* is an enlarged detailed view of a Jerusalem cross as an example for the passive radiating structure.

FIGS. 15*a* and 15*b* show, purely by way of example, a further simplified variant of a passive radiating structure which in FIG. 15*a* is provided in the form of a simple strip (rectangular strip) and in FIG. 15*b* in the form of such a rectangular strip, on each of the opposing ends of which a transverse bar is provided. From two such structures shown in FIG. 15*b* and arranged rotated through 90° to one another, the Jerusalem cross shown in FIG. 13*a* is formed.

Finally, it should also be mentioned that the aforementioned composite film can comprise and have not only one metal layer or metal film, but a plurality of metal layers, that is, a plurality of metal films which can possibly be provided with the structures described, and also with different structures. This composite film with the at least two or more metal layers or films with the structures possibly provided thereon, or different structures, can be arranged, for example, offset relative to one another.

Finally, the mounting of the composite film on the radome is also possible such that, for example, the composite film with the at least one metal film or metal layer is attached on the rear side and/or on a part of the side wall regions more or less full-surface, and acts here as a subreflector, and that other parts of the composite film are configured with the aforementioned structures in order to influence the beam shape accordingly. In other words, therefore, mixed forms which are implemented on a radome are possible. For example, a combined composite film can be provided which is configured full-surface, particularly in the rearward region of the radome and in parts of the side region and/or is provided in particular side wall regions or on the front side with corresponding structures. Any desired mixed forms are conceivable.

The invention has been described using a composite film, which preferably always has at least one plastics carrier layer. However, it should also be mentioned that it is also altogether possible, in place of the aforementioned composite film, always to use a pure metal film that is applied, particularly glued, onto the outer surface, i.e. the outer skin, of the radome. This metal film can also be provided with a self-adhesive layer. Thus, all the advantages and embodiments described should also be understood such that in place of the composite film 41 comprising one or more plastics carrier layers, merely a metal film without additional plastics carrier layers and films can be used or provided.

In place of the adhesive layer used also, generally, a bonding layer can be used which also permits the composite film or the metal film to be attached, anchored and firmly fixed onto the outer surface of the radome in another manner.

The invention claimed is:

1. A mobile communications antenna comprising:

a reflector on which one or more radiators are arranged, the reflector with the one or more radiators arranged thereon being accommodated in a radome comprising a front side, first and second side walls and a rear side, and a radiating structure which is provided at both of the first and second side walls, the radiating structure consisting of a passive radiating structure, wherein a) the passive radiating structure is formed by structured metal surfaces which are surrounded by metal-free regions, or b) the passive radiating structure is formed by cut-outs in a metal film or metal layer, the passive radiating structure consisting of a composite film comprising at least one plastics carrier layer and a metal film or layer attached thereto, the composite film being attached or glued onto an outer surface or outer skin of the radome.

2. The mobile communications antenna according to claim 1, wherein the passive radiating structure is constructed in the form of dipoles or in the form of magnetic dipoles.

3. The mobile communications antenna according to claim 1, wherein the passive radiating structure is arranged periodically repeating on the radome, in a longitudinal direction of the radome.

4. The mobile communications antenna according to claim 1, wherein the passive radiating structure is formed rotationally symmetrical or have a 90°, 120° or 180° rotational symmetry.

5. The mobile communications antenna according to claim 1, wherein the passive radiating structure comprises one of a plurality of structural forms (A, B, C), specifically in the manner of a central structural form (A), wherein individual portions run together in a center of the passive radiating structure, or in the manner of a loop structure (B) with an enclosing of an inner surface, or in the manner of a full-surface radiating structure (C).

6. The mobile communications antenna according to claim 1, wherein the passive radiating structure is configured as a cruciform, in the manner of a Jerusalem cross or in the manner of an n-polygon or a regular n-polygon with a surrounded inner surface, in the form of a hexagon.

7. The mobile communications antenna according to claim 1, wherein the composite film is configured as a self-adhesive composite film with an associated adhesive layer.

8. The mobile communications antenna according to claim 1, wherein the composite film is constructed and glued onto the outer surface of the radome such that the plastics carrier layer is arranged externally, after which the metal film or layer lying facing the radome and thereafter, an adhesive layer follows.

9. The mobile communications antenna according to claim 1, wherein the composite film is constructed and glued onto the outer surface of the radome such that the plastics carrier layer is arranged externally, after which the metal layer lying facing the radome and a further plastics carrier layer and thereafter an adhesive layer follows.

10. The mobile communications antenna according to claim 1, wherein between the individual layers, i.e. the plastics carrier layer and the metal layer, a bonding agent layer is formed.

11. The mobile communications antenna according to claim 1, wherein the externally arranged plastics carrier layer is printed with printed images in black and white or color.

12. The mobile communications antenna according to claim 1, wherein an externally arranged plastics carrier layer consists of polyethylene terephthalate (PET) or comprises this material.

13. The mobile communications antenna according to claim 1, wherein the at least one or a second plastics carrier layer consists of polyethylene (PE) or comprises polyethylene (PE), in the form of strongly branched polymer chains with low density.

14. The mobile communications antenna according to claim 1, wherein the metal film or layer in the composite film consists of or comprises a rust-free material and in particular brass, copper, aluminum, tin or zinc.

15. The mobile communications antenna according to claim 1, wherein the composite film is glued in the entire peripheral direction of the radome covering it full-surface.

16. The mobile communications antenna according to claim 1, wherein the composite film is glued over an entire length of the radome or at least in a region of more than 50%, 60%, 70%, 80% or 90% of a total length of the radome.

17. The mobile communications antenna according to claim 1, wherein the passive radiating structure consists of frequency-selective surfaces.

18. A mobile communications antenna comprising:

a reflector on which one or more radiators are arranged, the reflector with the one or more radiators arranged thereon being accommodated in a radome comprising a front side, first and second side walls and a rear side, and a radiating structure which is provided at both of the first and second side walls and the front side of the radome, the radiating structure comprising a passive radiating structure is formed by structured metal surfaces which are surrounded by metal-free regions or cut-outs in a metal film or metal layer, the passive radiating structure comprising a composite film comprising at least one plastics carrier layer and a metal film or layer attached thereto, the composite film being attached or glued onto an outer surface or outer skin of the radome.

* * * * *